US007126621B2

(12) United States Patent
Castelli et al.

(10) Patent No.: US 7,126,621 B2
(45) Date of Patent: Oct. 24, 2006

(54) PRINTER USING HYBRID REFLEX WRITING TO COLOR REGISTER AN IMAGE

(75) Inventors: Vittorio Castelli, Yorktown Heights, NY (US); Joannes N. M. deJong, Hopewell Junction, NY (US); Lloyd A. Williams, Mahopac, NY (US); Matthew Dondiego, West Milford, NJ (US); William J. Nowak, Webster, NY (US)

(73) Assignee: Xerox Corporation, Stamford, CT (US)

( * ) Notice: Subject to any disclaimer, the term of this patent is extended or adjusted under 35 U.S.C. 154(b) by 329 days.

(21) Appl. No.: 10/909,075

(22) Filed: Jul. 30, 2004

(65) Prior Publication Data

US 2006/0024104 A1 Feb. 2, 2006

(51) Int. Cl.
*B41J 2/47* (2006.01)

(52) U.S. Cl. ..... 347/234

(58) Field of Classification Search ..... 347/234
See application file for complete search history.

(56) References Cited

U.S. PATENT DOCUMENTS

| | | | |
|---|---|---|---|
| 3,930,724 | A | 1/1976 | McVeigh |
| 4,003,745 | A | 1/1977 | Blanks |
| 4,078,929 | A | 3/1978 | Gundlach |
| 5,113,202 | A | 5/1992 | Loce et al. |
| 5,208,636 | A | 5/1993 | Rees et al. |

(Continued)

FOREIGN PATENT DOCUMENTS

| | | | |
|---|---|---|---|
| EP | 0 249 633 | B1 | 11/1991 |

(Continued)

*Primary Examiner*—Hai Pham
*Assistant Examiner*—Kainoa Wright
(74) *Attorney, Agent, or Firm*—Maginot Moore Beck

(57) ABSTRACT

An imaging device for producing multicolor images from image data containing data representing an image of a first color and an image of a second color to be registered relative to the image of the first color onto a substrate by transferring toner of the first and second colors to the substrate is provided. The imaging device includes a first imager, a second imager, a photoreceptor belt, a plurality of rollers mounted to a frame of the imaging device, an angular position sensor, an image data source and a controller. The plurality of rollers define a process path along which the photoreceptor belt is driven past the first and second imagers in a process direction. The plurality of rollers includes a drive roller that exhibits an eccentricity for which a formula relating angular position as a function of the phase angle of the drive roller to eccentricity is known. The angular position sensor detects the phase angle of the drive roller. The image data source generates image data that includes a line to be printed in the first color and in the second color. The controller is coupled to receive signals from the angular position sensor, ROS imager and image data source and is configured to drive the second imager to generate an optical output. The controller includes memory and a processor. The memory stores the formula relating angular position as a function of the phase angle of the drive roller to eccentricity. The processor calculates an appropriate time delay for starting the generation of the optical output of the second imager for printing the line to be printed in the first color and in the second color based on the time of the starting of the optical output by the ROS imager to print to print that line, the signal received from the angular position sensor, and the formula relating angular position as a function of the phase angle of the drive roller to eccentricity.

20 Claims, 5 Drawing Sheets

U.S. PATENT DOCUMENTS

| | | | | |
|---|---|---|---|---|
| 5,281,999 | A | 1/1994 | Edmunds | |
| 5,351,070 | A | 9/1994 | Hinton et al. | |
| 5,383,014 | A | 1/1995 | Nowak et al. | |
| 5,394,223 | A | 2/1995 | Hart et al. | |
| 5,412,302 | A * | 5/1995 | Kido et al. | 318/685 |
| 5,493,385 | A * | 2/1996 | Ng | 399/40 |
| 5,644,352 | A | 7/1997 | Chang et al. | |
| 5,751,299 | A | 5/1998 | Denton et al. | |
| 5,828,387 | A * | 10/1998 | Wataya et al. | 347/14 |
| 5,895,738 | A | 4/1999 | Parker et al. | |
| 6,133,932 | A * | 10/2000 | Webb et al. | 347/232 |
| 6,307,578 | B1 * | 10/2001 | Castelli | 347/116 |
| 6,320,344 | B1 * | 11/2001 | Sakamoto et al. | 318/567 |
| 6,603,574 | B1 * | 8/2003 | Ramirez et al. | 358/1.9 |
| 6,644,773 | B1 | 11/2003 | Bildstein et al. | |
| 2004/0032389 | A1 | 2/2004 | Liang et al. | |
| 2004/0086304 | A1 * | 5/2004 | Metzler et al. | 399/301 |
| 2004/0208672 | A1 * | 10/2004 | Igarashi | 399/167 |
| 2004/0218947 | A1 * | 11/2004 | Oohara et al. | 399/167 |

FOREIGN PATENT DOCUMENTS

| | | |
|---|---|---|
| EP | 0 332 696 B1 | 3/1994 |
| EP | 0 903 643 | 3/1999 |

* cited by examiner

PRINTER USING HYBRID REFLEX WRITING TO COLOR REGISTER AN IMAGE

BACKGROUND AND SUMMARY

This invention relates generally to imaging devices and more particularly to imaging devices with a plurality of imagers that provide sequential images to form a composite image.

Imaging devices often utilize a first color to produce an image portions of which are desired to be highlighted using a second color. In order to produce the desired results the imaging device must precisely register the highlight color with the first image. Highlight color image registration is often challenging. It is often the case that a highlight printer is designed as a retrofit of a monochromatic engine in which the quality of the motion of the photoreceptor is only good enough to limit the banding to a tolerable level. The monochromatic image is typically laid down at a constant rate of lines per unit time. If the second imager is also caused to write at a constant rate, serious errors in color to color registration may occur.

In single pass electrophotographic printers having more than one process station which provide sequential images to form a composite image, critical control of the registration of each of the sequenced images is required. This is also true in multiple pass color printers, which produce sequential developed images superimposed onto a photoreceptor belt for charging with toner to form a multi-color image. Failure to achieve registration of the images yields printed copies in which the color separations forming the images are misaligned. This condition is generally obvious upon viewing of the copy; as such copies usually exhibit fuzzy color separation between color patches, bleeding and/or other errors which make such copies unsuitable for intended uses.

A typical highlight color reproduction machine records successive electrostatic latent images on the photoconductive surface. When combined, these electrostatic latent images form a latent image corresponding to the entire original document being printed. One latent image is usually developed with black toner. The other latent image is developed with color highlighting toner, e.g. red toner. These developed toner powder images are transferred sequentially to a sheet to form a color highlighted document. Such color highlighting reproduction machine can be of the so-called single-pass variety, where the color separations are generated sequentially by separate imaging and toning stations, or of the so-called multiple-pass variety, where the separations are generated by a single imaging station in subsequent passes of the photoreceptor and are alternatively toned by appropriate toning stations. A particular variety of single-pass highlight color reproduction machines using tri-level printing has also been developed. Tri-level electrostatographic printing is described in greater detail in U.S. Pat. No. 4,078,929. As described in this patent, the latent image is developed with toner particles of first and second colors simultaneously. The toner particles of one of the colors are positively charged and the toner particles of the other color are negatively charged.

Another type of color reproduction machine which may produce highlight color copies initially charges the photoconductive member. Thereafter, the charged portion of the photoconductive member is discharged to form an electrostatic latent image thereon. The latent image is subsequently developed with black toner particles. The photoconductive member is then recharged and image wise exposed to record the highlight color portions of the latent image thereon. A highlight latent image is then developed with toner particles of a color other than black, e.g. red, and then developed to form the highlight latent image. Thereafter, both toner powder images are transferred to a sheet and subsequently fused thereto to form a highlight color document.

The operation of highlight and color printers is well known and is described in greater detail in U.S. Pat. Nos. 5,113,202; 5,208,636; 5,281,999; and 5,394,223, the disclosures of which are hereby incorporated herein by this reference.

A simple, relatively inexpensive, and accurate approach to register latent images superimposed in such printing systems has been a goal in the design, manufacture and use of electrophotographic printers. This need has been particularly recognized in the color and highlight color portion of electro-photography. The need to provide accurate and inexpensive registration has become more acute, as the demand for high quality, relatively inexpensive color images has increased.

The disclosed imaging device utilizes a second imager for forming the highlight latent image at a time following the forming of the first latent image that accounts for irregularities in the movement of the photoreceptor belt between the first imager and the second imager. If the second imager is an LED bar as disclosed herein, one can take advantage of its ability to fire a line of data whenever it is most appropriate for color registration.

According to one aspect of the disclosure, an imaging device for producing multicolor images from image data containing data representing an image of a first color and an image of a second color to be registered relative to the image of the first color onto a substrate by transferring toner of the first and second colors to the substrate is provided. The imaging device comprises a first imager, a second imager, a photoreceptor belt, a plurality of rollers, an angular position sensor, a first index sensor, a second index sensor, an image data source and a controller. The first imager is configured to generate an optical output corresponding to the image of the first color at a first exposure station. The second imager is configured to generate an optical output corresponding to the image of the second color at a second exposure station. The photoreceptor belt is configured to have a charge placed thereon for modification by the optical output of the first imager to be receptive to a charged toner of the first color and for modification by the optical output of the second imager to be receptive to a charged toner of the second color, the photoreceptor belt being configured to include an index. The plurality of rollers are mounted to a frame of the imaging device for defining a process path along which the photoreceptor belt is driven in a process direction. The plurality of rollers comprises a drive roller and a tensioning roller. The drive roller has a longitudinal axis about which it is mounted to rotate and a drive surface formed generally concentrically about the longitudinal axis for which eccentricity versus phase angle from a reference point data is known. The drive surface has a nominal circumference and is configured to drive the photoreceptor belt. The tensioning roller provides tension to the photoreceptor belt as it is driven about the process path. The angular position sensor detects the phase angle of the drive roller from the reference point. The first index sensor is mounted along the process path for sensing the passage of the index on the belt. The second index sensor is mounted along the process path for sensing the passage of the index on the belt. The image data source generates image data for generating an image including graphics of the first color and graphics of the second color. The image data includes a line to be printed in the first color and in the second color. The controller is coupled to receive signals from the first index sensor, second index sensor, angular position sensor, first imager and image data source and is configured to drive the second imager to generate an optical output. The controller includes memory and a processor. The memory stores the eccentricity versus phase angle from a reference point data, the time at which the first index sensor senses the passage of the index on the belt, and the time at which the second index sensor senses the passage of the index on the belt. The processor calculates an appropriate time delay for starting the generation of the optical output of the second imager for printing the line to be printed in the first color and in the second color based on the time of the starting of the generation of the optical output by the first imager to print the line to be generated in the first color and in the second color, the signal received from the first index sensor, the signal received from the second index sensor, the signal received from the angular position sensor, and the eccentricity versus phase angle from a reference point data.

According to another aspect of the disclosure, an imaging device for producing multicolor images from image data containing data representing an image of a first color and an image of a second color to be registered relative to the image of the first color onto a substrate by transferring toner of the first and second colors to the substrate is provided. The imaging device comprises a raster output scanner ("ROS") imager, a light emitting diode ("LED") imager, a photoreceptor belt, a plurality of rollers mounted to a frame of the imaging device, an angular position sensor, an image data source and a controller. The ROS imager is configured to generate an optical output corresponding to the image of the first color at a first exposure station. The LED imager is configured to generate an optical output corresponding to the image of the second color at a second exposure station. The photoreceptor belt is configured to have a charge placed thereon for modification by the optical output of the ROS imager to be receptive to a charged toner of the first color and for modification by the optical output of the LED imager to be receptive to a charged toner of the second color. The plurality of rollers mounted to a frame of the imaging device define a process path along which the photoreceptor belt is driven past the ROS and LED imagers in a process direction. The plurality of rollers comprises a drive roller having a longitudinal axis about which it is mounted to rotate and a drive surface formed generally concentrically about the longitudinal axis. The drive roller exhibits an eccentricity for which a formula relating angular position as a function of the phase angle of the drive roller to eccentricity is known. The drive surface has a nominal circumference and is configured to drive the photoreceptor belt. The angular position sensor detects the phase angle of the drive roller. The image data source generates image data for generating an image including graphics of the first color and graphics of the second color. The image data includes a line to be printed in the first color and in the second color. The controller is coupled to receive signals from the angular position sensor, ROS imager and image data source and is configured to drive the LED imager to generate an optical output. The controller includes memory and a processor. The memory stores the formula relating angular position as a function of the phase angle of the drive roller to eccentricity. The processor calculates an appropriate time delay for starting the generation of the optical output of the LED imager for printing the line to be printed in the first color and in the second color based on the time of the starting of the generation of the optical output by the ROS imager to print the line to be generated in the first color and in the second color, the signal received from the angular position sensor, and the formula relating angular position as a function of the phase angle of the drive roller to eccentricity.

Additional features and advantages of the present invention will become apparent to those skilled in the art upon consideration of the following detailed description of preferred embodiments exemplifying the best mode of carrying out the invention as presently perceived.

BRIEF DESCRIPTION OF THE DRAWINGS

A more complete understanding of the disclosed apparatus can be obtained by reference to the accompanying drawings wherein.

Figure 1:
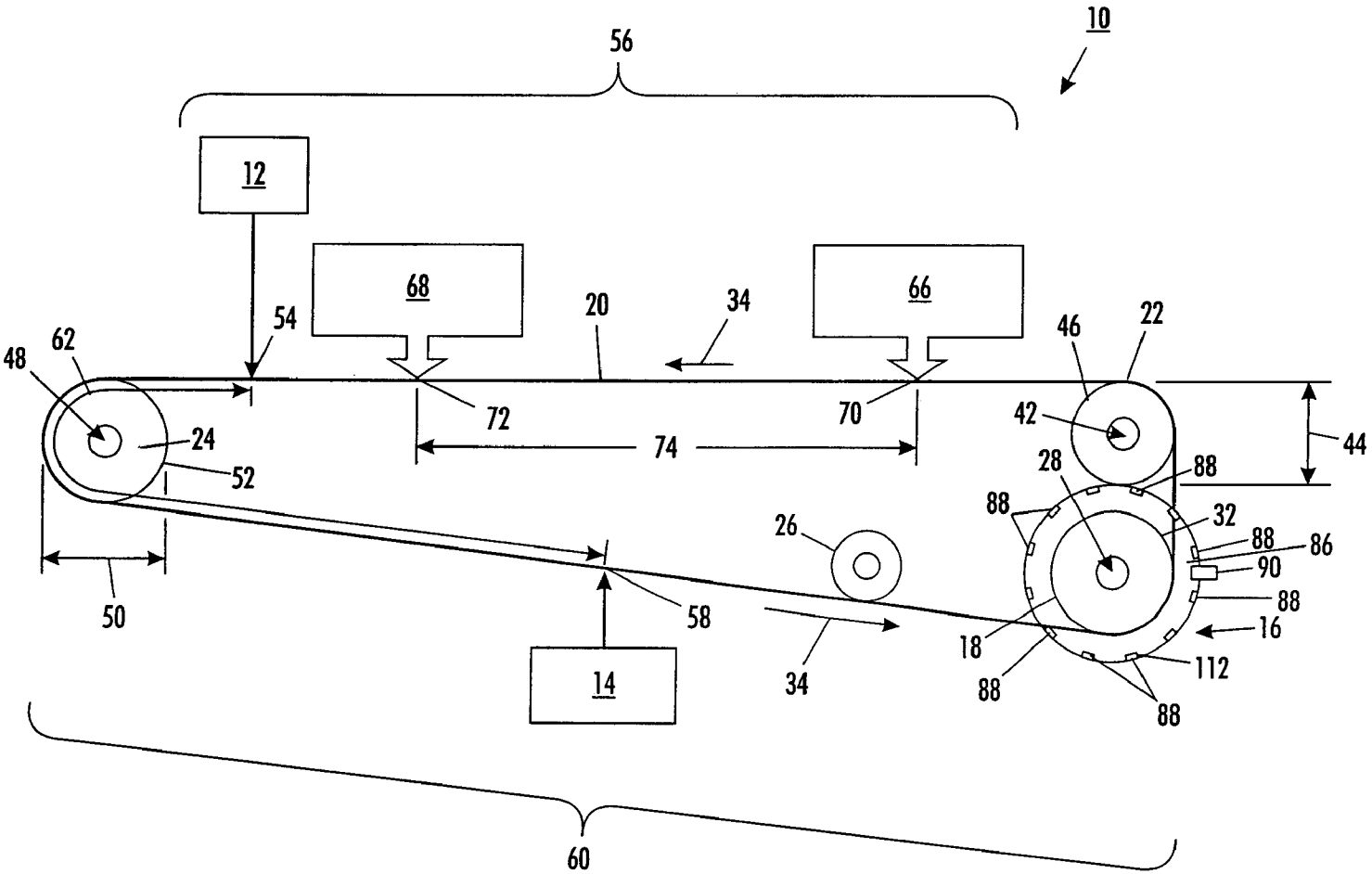
FIG. 1 is a schematic side view of an imaging device with components removed for clarity showing a drive roller including a rotary encoder associated therewith, a stripper roller, a tensioning roller and a guide roller, a photoreceptor belt entrained on the drive roller, stripper roller, tensioning roller and guide roller for movement along a processing path, a first belt hole sensor, a second belt hole sensor, a first imager and a second imager.

These figures merely illustrate the disclosed methods and apparatus and are not intended to exactly indicate relative size and dimensions of the device or components thereof.

DETAILED DESCRIPTION OF THE DRAWINGS

The disclosed imaging device 10 records the history of the place and time associated with the lines laid by the first imager 12, and computes an appropriate (variable) delay for each of the lines laid by the second imager 14. The method herein disclosed compensates for the color-to-color registration errors caused by irregularities in the belt motion. The proposed method employed by the machine controller takes advantage of a rotary encoder 16 mounted on the drive roller 18 in a manner to be explained below. Furthermore, a method is introduced to compensate for manufacturing errors in the driver roller 18 and in the encoder artwork and its mounting. For belt photoreceptor systems, this invention also compensates for geometrical errors induced by temperature variations on the length of the photoreceptor belt 20 and on the diameter of the drive roller 18.

The method and device are described for a two color highlight printer 10 having a belt photoreceptor system. Those skilled in the art will recognize that the teachings of the disclosure could be applied to a multicolor printer or other imaging device such as a photocopy machine within the scope of the disclosure.

A simplified diagram of a two color highlight imaging device 10 is shown, for example, in FIG. 1. Belt charging stations, toner application stations, image transfer stations, substrate transport stations, substrate developer stations and belt cleaning stations are not illustrated in FIG. 1. Such devices and their arrangement are well known. Examples of more completely described highlight imaging devices are disclosed in the incorporated U.S. Pat. Nos. 5,113,202; 5,208,636; 5,281,999; and 5,394,223.

The imaging device 10 includes a photoreceptor belt 20 that is mounted for rotation about a plurality of rollers 18, 22, 24, 26 mounted to a frame of the imaging device 10. In the illustrated embodiment, the plurality of rollers includes a stripper roller 22, the drive roller 18, a tensioning roller 24 and a guide roller 26. The rollers 18, 22, 24 and 26 define a process path along which the photoreceptor belt 20 progresses during image production. It is within the scope of the disclosure for fewer or more rollers to be utilized to define the process path guiding the photoreceptor belt 20 as it moves in a process direction (indicated by arrow 34).

Figure 3:
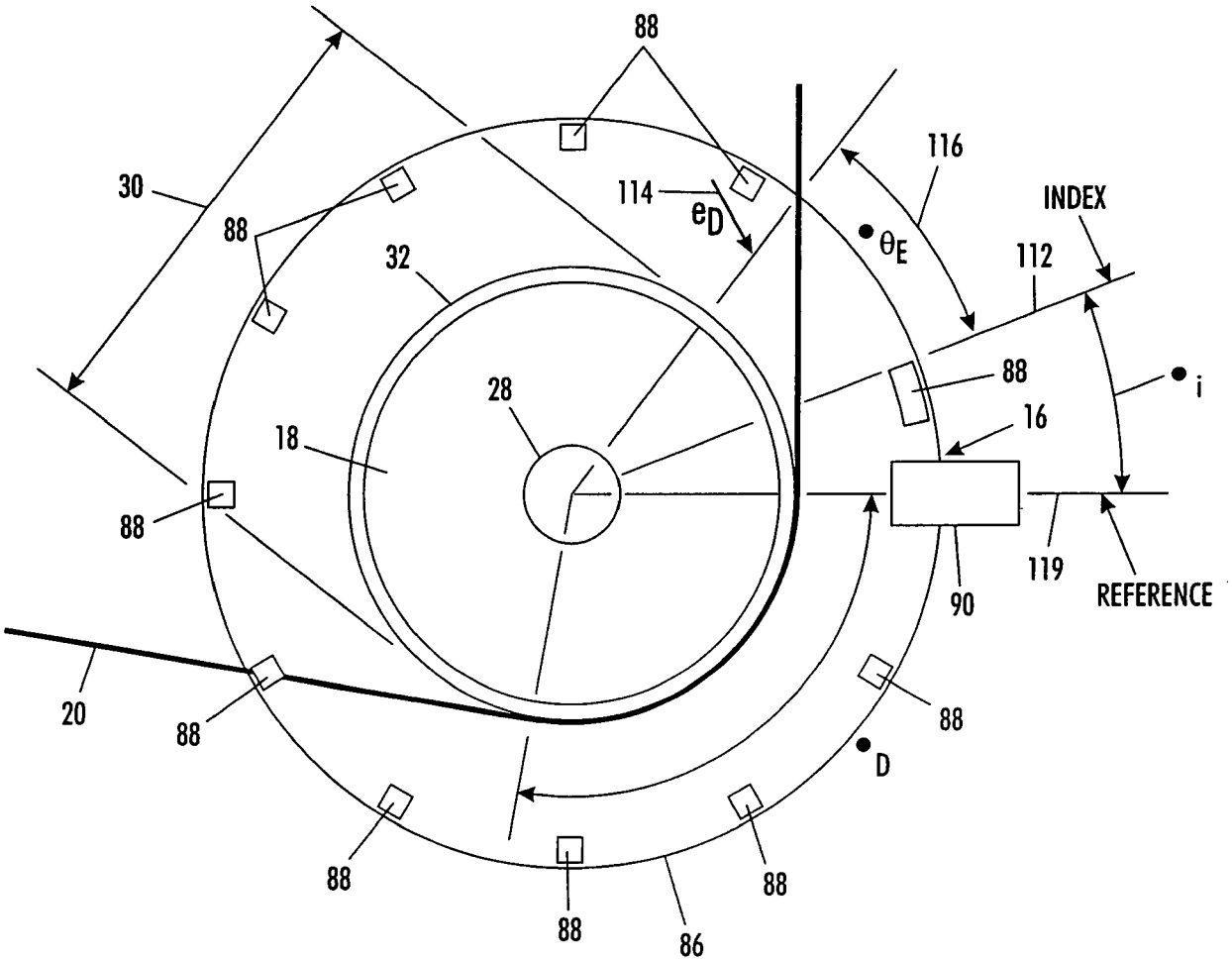
FIG. 3 is a diagram of the drive roller with the photoreceptor wrapped there about of the imaging device of FIG. 1.

In the illustrated embodiment, drive roller 18 is a generally cylindrical roller having a longitudinal axis 28, a nominal diameter 30, shown in FIG. 3, and a drive surface 32 having a nominal circumference formed generally concentrically about the symmetry axis 28. The drive roller 18 is mounted to the frame of the imaging device 10 to rotate when driven about its axis 28. The symmetry axis 28 is mounted generally perpendicular to the process direction 34. A rotary encoder 16 is associated with the drive roller 18 to sense the angular position (and consequently the angular velocity) of the drive roller 18. Thus, rotary encoder 16 acts as an angular position sensor for sensing the angular position of the drive roller relative to a reference. Illustratively the rotary encoder 16 is configured to generate a number of pulses during each revolution of the drive roller 18. The number of pulses generated by the rotary encoder 16 during each revolution of the drive roller 18 is an integer value. In the illustrated embodiment, the rotary encoder 16 is mounted to the shaft of the drive roller 18. The rotary encoder 16 may be implemented using a 1024 pulse per revolution rotary encoder available from Opto-Generic Devices, Inc. as part no. 146K00262. A reference angular position of the drive roller 18 can be generated by a separate sensor, such as a Hall sensor, or an added feature of the encoder itself. The signal generated by the rotary encoder 16 is received by the controller 40 of the imaging device 10.

In the illustrated embodiment, the stripper roller 22 is a generally cylindrical roller having a symmetry axis 42, a nominal diameter 44 and a belt engaging surface 46 formed generally concentrically about the axis 42. The stripper roller 22 is mounted to the frame of the imaging device 10 to rotate about its symmetry axis 42. The axis 42 is mounted generally perpendicular to the process direction 34. In the illustrated embodiment, the stripper roller 22 is mounted downstream of the driver roller 18 along the process path in the process direction 34. In the illustrated embodiment, the nominal diameter 44 of the stripper roller 22 is smaller than the nominal diameter 30 of the drive roller 18.

In the illustrated embodiment, the tensioning roller 24 is a generally cylindrical roller having a symmetry axis 48, a nominal diameter 50 and a belt-engaging surface 52 formed generally concentrically about the axis 48. The tensioning roller 24 is mounted to the frame of the imaging device 10 to rotate about its symmetry axis 48. The tensioning roller 24 is mounted for linear movement relative to the frame of the imaging device 10 perpendicularly to its axis 48, the movement such as to maintain said axis 48 on a plane nearly parallel to the belt surface in the span between rollers 22 and 24. A force is applied so as to provide tension to the photoreceptor belt 20. The symmetry axis 48 is mounted generally perpendicular to the process direction (indicated by arrow 34). In the illustrated embodiment, the nominal diameter 50 of the tensioning roller 24 is smaller than the nominal diameter 30 of the drive roller 18.

In the simplified embodiment illustrated in FIG. 1, a single guide or idler roller 26 is mounted to the frame of the imaging device 10 to aid in defining the process path along which the photoreceptor belt 20 travels. Those skilled in the art will recognize that a typical imaging device 10 will include a plurality of such guide or idler rollers 26 mounted to the frame of the imaging device 10 acting to support the photoreceptor belt 20 and to define the process path along which it travels. Additional structures, such as backer bars or rollers, blades and other components may aid in supporting the photoreceptor belt 20 and defining the process path along which it progresses, within the scope of the disclosure.

The first imager 12 is located between the tensioning roller 24 and the stripper roller 22 for producing a latent image on the photoreceptor belt 20 as it passes by the first imager 12. The first imager 12 is mounted adjacent the photoreceptor belt 20 to scan an image at a first exposure station 54 onto the photoreceptor belt 20. Illustratively, the first exposure station 54 is positioned along the process path between the stripper roller 22 and the tensioning roller 24 in what will be referred to herein as the first imager span 56 of the process path. In the illustrated embodiment, the first imager 12 is taken to be a laser Raster Output Scanner ("ROS") of the type commonly used in monochromatic imaging devices.

The second imager 14 is located between the tensioning roller 24 and the guide roller 26 to produce a second image on the photoreceptor belt 20 as it passes by the second imaging device. The second imager 14 is mounted adjacent to the photoreceptor belt 20 to scan an image at a second exposure station 58 onto the photoreceptor belt 20. Illustratively, the second exposure station 58 is positioned along the process path between the tensioning roller 24 and the drive roller 18 in what will be referred to herein as the second imager span 60 of the process path. The second exposure station 58 is displaced in the process direction along the process path by a displacement 62 from the first exposure station 54. The displacement 62 is designed to be as closely as possible equal to an integral multiple of the nominal circumference of the drive roller 18 for reasons that will be explained below. In the illustrated embodiment, the second imager 14 is a Light Emitting Diode ("LED") bar which can scan an image line on demand.

Figure 4:
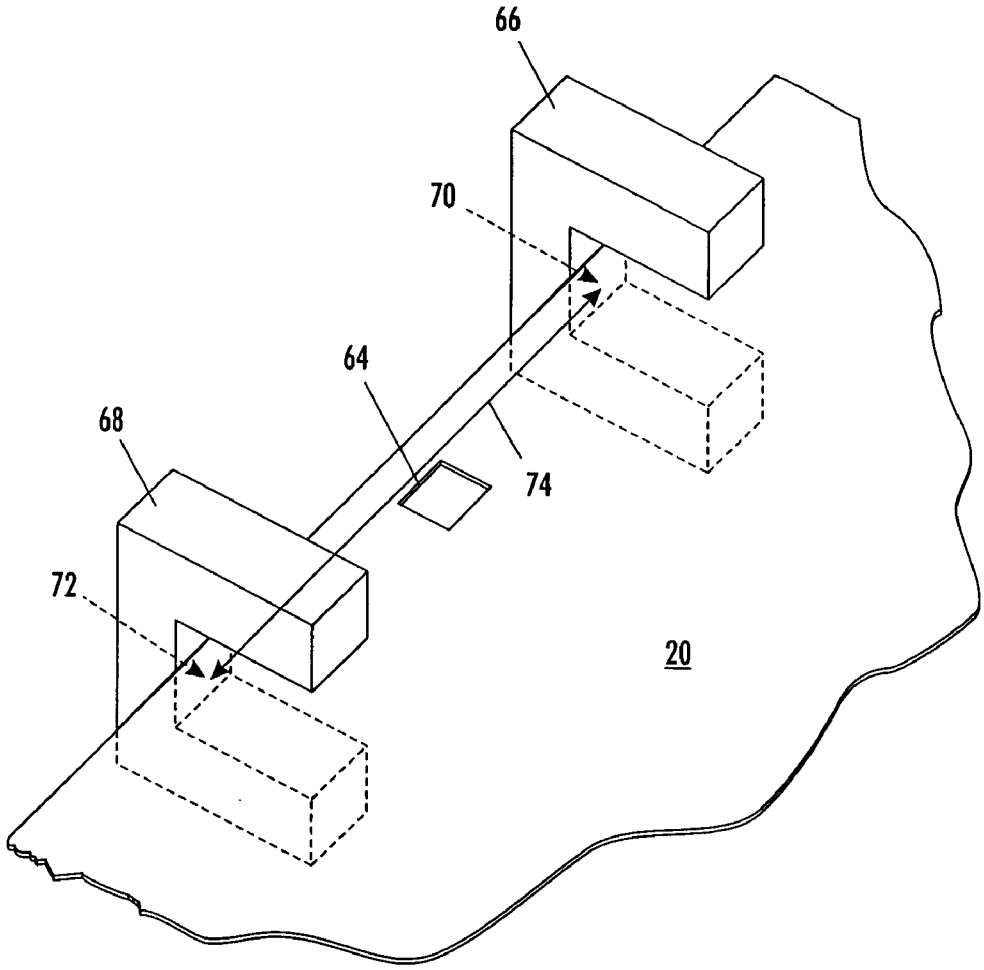
FIG. 4 is a perspective view of a portion of the imaging device of FIG. 1 showing an index hole formed along one edge of the photoreceptor belt and belt hole sensors for sensing the passage of the index hole.

The photoreceptor belt 20 is formed to include an index mark 64, shown in FIG. 4, that can be sensed by index sensors 66, 68 to determine when the index 64 passes a point in the field of sensitivity of the index sensors 66, 68. In the illustrated embodiment, the index 64 is a hole 64 formed through the thickness and near an edge of the belt 20 and the index sensors 66, 68 are belt hole sensors 66, 68. Illustratively, belt hole sensors 66, 68 may be implemented utilizing an Optek PHOTOLOGIC® slotted optical switch, such as Part Number OPB961N51 available from Optek Technology, Inc., 1215 W. Crosby Road Carrollton, Tex. 75006. Such an optical switch includes an emitter and a sensor sensitive to the signal emitted by the emitter. The sensor is mounted in one leg and the emitter is mounted in the other leg of a U-shaped housing. The legs of the U-shaped housing form a slot. The U-shaped housing of each belt hole sensor 66, 68 is mounted to the frame of the imaging device 10 so that the edge of the photoreceptor belt 20 containing the index hole 64 passes through the slot in the U-shaped housing. When the hole 64 is within the slot of a belt hole sensor 66, 68, the sensor senses the signal emitted by the emitter and the belt hole sensor 66, 68 sends a signal to the controller 40. Those skilled in the art will recognize that other sensors and indexes could be used within the scope of the disclosure to sense the passage of a particular point on the photoreceptor belt 20. For instance optical sensors capable of sensing the passage of a reflective mark on the belt, proximity sensors, inductive sensors and other sensors could be utilized within the scope of the disclosure.

The first belt hole sensor 66 is mounted upstream of the first exposure station 54 in the first imager span 56 of the process path. As mentioned above, the first belt hole sensor 66 is mounted to sense the passage of the hole 64 formed in the photoreceptor belt 20 past a first index sensor location 70. The first belt hole sensor 66 is coupled to the controller 40 and configured to send a first hole passage signal to the controller 40 upon sensing the passage of the hole 64 past the first index sensor location 70.

The second belt hole sensor 68 is mounted upstream of the first exposure station 54 and downstream of the first belt hole sensor 66 in the first imager span 56 of the process path. The second belt hole sensor 68 is mounted to sense the passage of the hole 64 formed in the photoreceptor belt 20 past a second index sensor location 72. The second index sensor location 72 is displaced downstream along the process path by a displacement 74 from the first index sensor location 70. The second belt hole sensor 68 is coupled to the controller 40 and configured to send a second hole passage signal to the controller 40 upon sensing the passage of the hole 64 past the second index sensor location 72.

Figure 2:
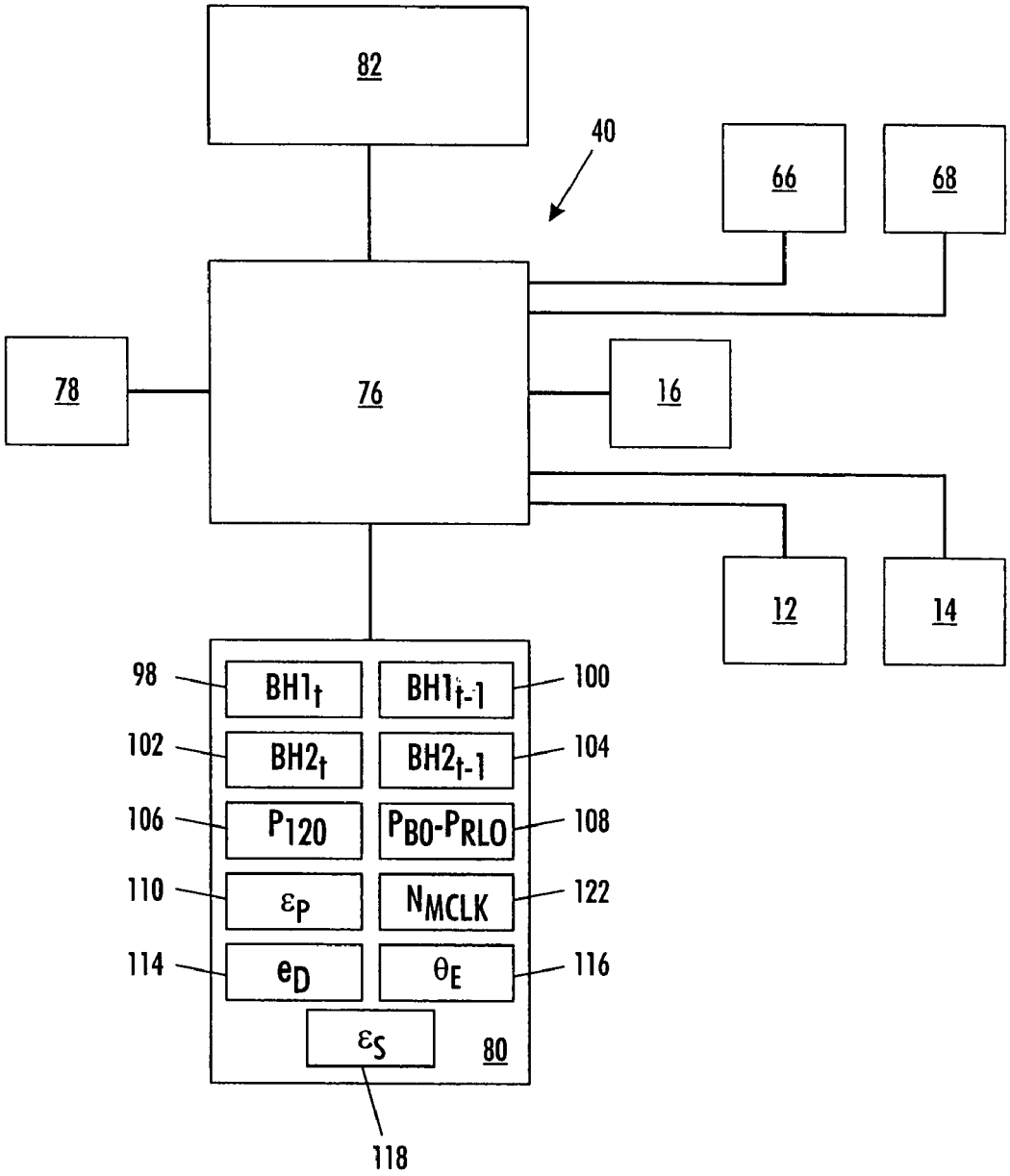
FIG. 2 is a schematic diagram of the sensors, imagers and controllers of the imaging device of FIG. 1.

As shown for example, in FIG. 2, the controller 40 includes a microprocessor 76, a clock 78 and memory 80. The microprocessor 76 processes image data received from an image data source 82 and drives the first imager 12 and second imager 14 to expose images on the photoreceptor belt 20 that can be developed to generate a print of an image corresponding to the image data received from the image data source 82. The image data source 82 may be the output of a raster input scanner, a computer file or the output of other image data generating devices within the scope of the disclosure. The image data represents an image that may include text or graphics some of which is to be printed in a first color and some of which is to be highlighted in a second color.

As mentioned above, a laser ROS of the type used as the first imager 12 writes subsequent lines at the first exposure station 54 using a laser beam, which is scanned by virtue of the spinning of a multifaceted polygon mirror. The rate at which the lines are laid (i.e. impressed upon the photoreceptor belt 20) is essentially constant in time. If the second imager 14 were to lay down image lines at a constant rate in time, and if the drive roller 18 rotates at an irregular rate, or if the length of the photoreceptor belt 20 varies during rotation as the result of mechanical or thermal expansion or contraction, the images can be distorted and the time delay between the passages of the same point of the photoreceptor under the first and the second imagers can vary in time. Usually the amount of distortion is small enough that it does not damage a monochromatic print. unless its magnitude and frequency are such as to create the so-called phenomenon of "banding", a periodic variation of image density at a spatial frequency in the neighborhood of one cycle per millimeter at normal viewing distance.

When, as in the disclosed apparatus, a second imager 14 is utilized to impress a second image on the photoreceptor belt 20, the irregularity of the motion of the photoreceptor belt 20 can cause the time delay between a selected area of photoreceptor belt 20 passing the first exposure station 54 and the second exposure station 58 to vary. The variation in the delay between a selected area of photoreceptor belt 20 passing the first exposure station 54 and second exposure station 58 results in improper registration of the second image with respect to the first image. As an example, in a highlight printer wherein the first imager creates text in a first color, which is to be interspersed or highlighted by text or logos in a second color, the improper registration of the second image with respect to the first image can result in misalignment of the highlight text or logos with the text of the first color, failure to highlight the desired text or even highlighting of inappropriate text. In a color printer generating full, typically four, color images using a plurality of imagers, improper registration of the various color images is an even larger problem.

The present invention proposes that the proper time delay between the first and the second exposure be computed for all image lines in a manner such that the geometrical and motion errors are compensated. In the disclosed device 10, the rotary encoder 16 mounted on the shaft of the drive roller 18 generates encoder pulses 84 that are sent to the microprocessor 76 of the controller 40. The controller 40 computes the delay between a selected portion of the photoreceptor belt 20 passing the first exposure station 54 adjacent the first imager 12 and the second exposure station 58 adjacent the second imager 14 as a nominal number of encoder pulses 84 ($N_{MCLK}$) plus a correction time ($P_{CORR}$). Those skilled in the art will recognize that a pulse 84 is generated by the rotary encoder 16 attached to the shaft of the rotating drive roller 18 each time the drive roller 18 has rotated through a specific angular displacement. Typically encoders producing 512 or 1024 pulses per revolution are used. Therefore, for a 50 mm diameter drive roll, a 1024 pulse per revolution encoder produces subsequent pulses at a spacing on the belt of approximately 0.153 millimeters, or 153 microns. It is understood that encoder pulses represent rotation angle and, therefore space on the belt surface. This space is not rigorously, but approximately, equal to time multiplied by the nominal angular velocity. For small corrections, such as it is the case in the applications of highlight color printers, the difference between the two is negligible.

An imaging system of the type disclosed generally attempts to drive the drive roller 18 at a nominal angular velocity. The displacement 62 between the first exposure station 54 of the first imager 12 and the second exposure station 58 of the second imager 14 along the path of rotation of the photoreceptor belt 20 is approximately known by design and can be evaluated at a particular time by calibration based on two reference lines laid by the ROS and the LED bar. In the illustrated device 10, this displacement 62 is selected to be an integral multiple of the nominal circumference of the drive roller 18, for reasons explained more fully below. Thus, a nominal time delay $N_{MCLK}$ 122 can be calculated for a selected location on the photoreceptor belt 20 to pass from the first exposure station 54 adjacent the first imager 12 to the second exposure station 58 adjacent the second imager 14. This nominal time delay $N_{MCLK}$ 122 is stored in memory 80 and corresponds to an integer number of encoder pulses 84 generated by the rotary encoder 16 attached to the shaft of the drive roller 18 driving the photoreceptor belt 20

However, this nominal number of rotary encoder pulses 84 $N_{MCLK}$ 122 will not always truly reflect the distance which a specific location on the photoreceptor belt 20 travels. Irregularities in the motion of the photoreceptor belt 20 can result from various causes. Irregularities in the motion of the photoreceptor belt 20 can arise due to irregularities in the drive roller rotation rate that repeat during every revolution of the drive roller 18, irregularities in the drive roller rotation rate that do not repeat during every revolution of the drive roller 18, eccentricity of the drive roller 18, eccentricity of the tension roll 24, eccentricity of the stripper roller 22, and thermal growth effects. To allow proper registration of the images produced on the photoreceptor belt 20 by the first imager 12 and the second imager 14, each of these causes of irregularities in the motion of the photoreceptor belt 20 should be taken into account. The disclosed imaging device 10 accounts for each of the causes of the irregularities in the motion of the photoreceptor belt 20 by adding a correction time ($P_{CORR}$ 120) to the nominal number of encoder pulses ($N_{MCLK}$ 122) from the sensed start of scan 94 of a line by the first imager 12 to the driven start of scan 96 of a line to be registered with the first imager line by the second imager 14.

Irregularities in the drive roller rotation rate that repeat during every revolution of the drive roller 18 are eliminated by making the displacement 62 along the path of motion of the photoreceptor belt of the first and second exposure stations 54, 58, respectively, equal to an integer multiple of the nominal circumference of the drive roller 18. This well known approach to reducing irregularities in the photoreceptor belt motion caused by irregularities in the drive roller rotation rate that repeat every revolution of the drive roller 18 is known as "synchronism" and is implemented in the disclosed device 10.

Eccentricity of the tensioning roller 24 causes a periodic displacement of the tensioning roller itself. This displacement acts against the tensioning force thus performing a periodic amount of mechanical work that must be provided by the motor driving the drive roller 18. The motor then feels a variable load resulting in a periodic variation in the rotational speed. The amplitude of this variation depends on the stiffness of the drive system including its controlling electronics. Typically, as shown herein, the diameter 50 of the tensioning roller 24 is different than the diameter 30 of the drive roller 18. Thus, eccentricity of the tensioning roller 24 does not create an irregularity in the rotation rate of the drive roller 18 that repeats every revolution. Thus, irregularities in photoreceptor belt motion caused by eccentricity of the tensioning roller 24 can be addressed along with all of the other causes of irregularities in the drive roller rotation rate that do not repeat every revolution of the drive roller 18. These effects will be treated below.

Figure 5:
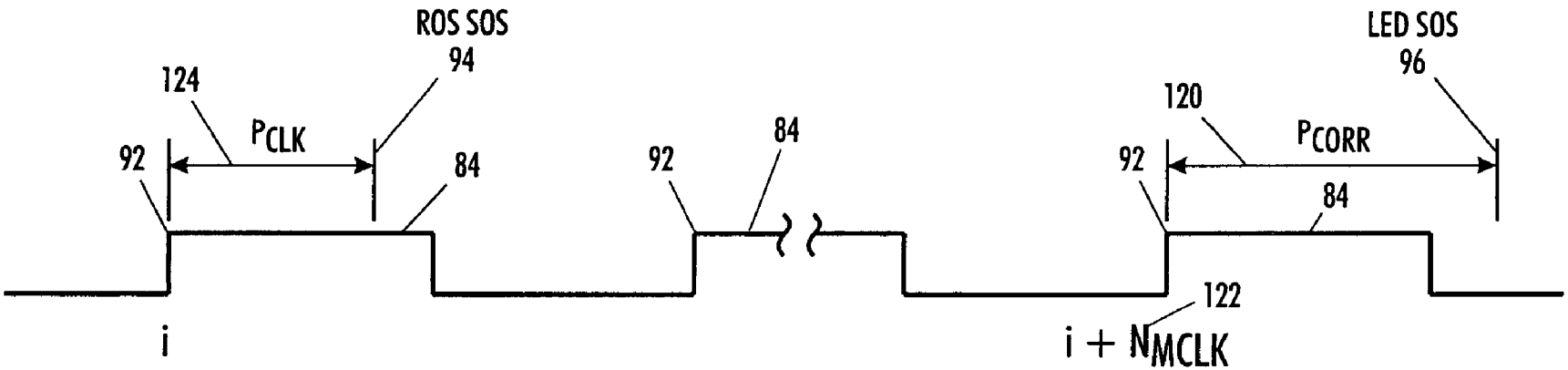
FIG. 5 is a timing diagram indicating the relation between the start of the scans of the first and second imagers showing corrections for properly registering the images produces by the imagers wherein pulses generated by the rotary encoder coupled to the drive roller are utilized as a clock mechanism for initiation of the scans.

This invention teaches that the correction of the registration errors by various causes be introduced as a variable time delay in the writing of the LED lines. This time delay can be positive or negative. The proposed computation of the appropriate time delay $\Delta T_{RB}$ between the ROS 12 and the LED bar 14 writing the same line is the sum of two components: $\Delta T_{RB}=N_{MCLC}+P_{CORR}$. These definitions are better understood referring to FIG. 5.

$N_{MCLK}$ 122 has been defined previously as the approximate nominal integer number of encoder pulses between location 54, where the ROS 12 writes, and the location 58, where the LED bar 14 writes. The writing time for the LED bar 14 after the ROS 12 writing time is a time $P_{CORR}$ 120 after the nominal number of encoder clock pulses $N_{MCLK}$ 122. $P_{CORR}$ 120 is equal to the sum of several factors: $P_{CORR}=P_{ICLK}+\epsilon_S+\Delta P_{RL}+\epsilon_P+\epsilon_E$. Each of these components of the error correction varies for every image scan line. $P_{ICLK}$ 124 is equal to the time between the last encoder pulse and the writing of the ROS scan line at location 54 measured from the rising edge 92 of the pulse until the start of the scan 94 by the ROS 12. Note that this value cannot be set to be equal to zero because it is not practical to so control the phase of the start of each ROS scan.

$\epsilon_S$ 118 is associated with the effect of the eccentricity of the stripper roller 22. This causes a periodic change in the motion of the photoreceptor belt 20 in the first imager span 56. Eccentricity of the stripper roller 22 does not however cause a periodic change in the motion of the photoreceptor belt 20 in the second imager span 60. To correct for eccentricity of the stripper roller 22, an index signal generating device needs to be mounted to the stripper roller 22 and the eccentricity of the stripper roller 22 needs to be measured together with its phase with respect to the above-mentioned index. During printing, the timing of the index pulse, the amplitude of the eccentricity, and the known phase between the two allow the calculation of the stripper roll eccentricity error $\epsilon_S$ 118 which is stored in memory 80. The index signal generating device for generating the phase angle of the stripper roller may be implemented in the same manner as the rotary encoder 16 mounted on the shaft of the drive roller 18 to generate encoder pulses that are sent to the microprocessor 76 of the controller 40 and is thus not separately illustrated or described.

$\Delta P_{RL}$ is the correction associated with the effect of the photoreceptor belt 20 and drive roller 18 expanding and contracting as a result of temperature changes. The tensioning roller 24 is coupled to a mechanism that allows the tensioning roller 24 to adjust its position to compensate for dimensional changes in the photoreceptor belt 20. Thus all of the dimensional changes in the photoreceptor belt 20 resulting from thermal expansion or contraction, as well as stretching caused by mechanical effects, are present solely within the first imager span 56 and second imager span 60. The dimensional changes in the drive roller 18 result in a change in the relationship between the angular velocity of the drive roller 18 and the linear velocity imparted to the photoreceptor belt 20 driven by the drive roller 18. The changes in the rate of the belt motion caused by thermal effects and mechanical stretching are eliminated by introducing two spaced apart belt hole sensors 66, 68 and providing at least one hole 64 in the photoreceptor belt 20 arranged to actuate the belt hole sensors 66, 68. The belt hole sensors 66, 68 sense the passage of the hole 64 in the photoreceptor belt 20 past the first and second belt hole sensor locations 70, 72, respectively and send signals to the controller 40 which time stamps the hole passage signals. The controller 40 stores in memory 80 the time stamped signal from the first belt hole sensor 66 as $BH1_t$ 98 and maintains in memory 80 the previous time stamped signal from the first belt hole sensor 66 as $BH1_{t-1}$ 100. The controller 40 stores in memory 80 the time stamped signal from the second belt hole sensor 68 as $BH2_t$ 102 and maintains in memory 80 the previous time stamped signal from the second belt hole sensor 68 as $BH2_{t-1}$ 104.

The thermal growth correction factor ($\Delta P_{RL}$) is computed by sensing $\Delta P_B$, which is equal to the variation of time required for one revolution of the photoreceptor belt 20, $\Delta P_{12}$, which is equal to the variation of time required for the hole 64 in the photoreceptor belt 20 to travel between the first belt hole sensor location 70 and the second belt hole sensor location 72, $P_{120}$ 106, which is equal to the initial time for the hole 64 in the photoreceptor belt 20 to travel from the first belt hole sensor location 70 to the second belt hole sensor location 72, and ($P_{B0}-P_{RL0}$ 108), which is equal to the nominal time for the belt 20 to travel from the LED bar writing location 58 and the ROS writing location 54. The growth compensation factor ($\Delta P_{RL}$) also takes into account the nominal time for a selected position on the photoreceptor belt 20 to move between the first exposure station 54 and the second exposure station 58. The formula for determining the thermal growth compensation factor $\Delta P_{RL}$ is:

$$\Delta P_{RL} = \Delta P_B - \frac{\Delta P_{12}(P_{B0} - P_{RL0})}{P_{120}}$$

Those skilled in the art will recognize that the thermal growth compensation time $\Delta P_{RL}$ also compensates for stretching of the photoreceptor belt due to mechanical factors.

Changes in the drive roll rotation rate that do not repeat during each revolution include one component that is a nominal amount that must be computed by calibration. $\epsilon_P$ 110 denotes this amount and it compensates for the fact that the manufacturing process does not produce a precise belt distance between the two imager stations. This correction can be evaluated by the operator by means of a test print upon which appropriate marks are printed by each of the first and second imagers 12, 14, respectively, activating lines on the photoreceptor belt 20, the appropriate toner being applied to each of these activated lines and transferring the toner to a medium such as paper. The operator may use optical magnification such as a loupe to view the marks and determine the appropriate correction. The value of $\epsilon_P$ 110 is stored in memory 80 to be accessed by the microprocessor at the time the correction formula $P_{CORR}$ is to be calculated.

The factor $\epsilon_E$ compensates for the effect of irregularities in the belt motion resulting from eccentricity of the drive roller 18. This can be best understood referring to FIG. 3. This compensation must be calibrated by measuring the phase angle of an index on the drive roller 18 and utilizing a measured value for the magnitude of the eccentricity of roller 18 and its phase $\theta_E$ with respect to the index. The index on the drive roller 18 may be implemented using a typically available feature of the encoder 16 mounted on the drive roller 18 or a separate index generating device may be mounted on the drive roller 18. The phase angle between the index and the eccentricity could be measured with the help of the encoder 16. In the illustrated embodiment, the index is generated by a sensor detecting a hole 112 on a circular plate 86 attached to the roller 18. In order to compute the desired correction factor for irregularities in the belt motion resulting from eccentricity of the drive roller 18, the eccentricity of the drive roller must be measured at the factory as a sinusoidal function. A more complex representation is also possible but it is typically not necessary. The correction factor for drive roller eccentricity $\epsilon_E$ is then computed as:

$$\epsilon_E = \epsilon_L[\theta(t)] - \epsilon_R[\theta(t - t_{RL})]$$

wherein t is the time, $t_{RL}$ is equal to the nominal time for a specified location on the belt 20 to pass from the first exposure station 54 associated with the first imager 12 to the second exposure station 58 associated with the second imager, $$\epsilon_L = e_D \sin[\theta(t) + \gamma_D];$$

$$\epsilon_R = e_D \sin \theta(t); \text{ and}$$

$$\theta(t) = \theta_i(t) + \theta_E.$$

In the above formulae, $\gamma_D$ is equal to the length of belt wrapped on the drive roller 18, $e_D$ 114 is the measured value of the eccentricity associated with the phase angle $\theta_E$ 116, and $\theta_i(t)$ is the phase angle of the index from a reference point 119 at all moments of time. In the illustrated embodiment, the reference point 119 coincides with radius extending from the longitudinal axis 28 of the drive roller 18 through the sensor 90 for sensing the passage of holes 88 in circular plate 86 of the rotary encoder 16.

Although the invention has been described with reference to specific preferred embodiments, it is not intended to be limited thereto, rather those having ordinary skill in the art will recognize that variations and modifications may be made therein which are within the spirit of the invention and within the scope of the claims.

What is claimed is:

1. An imaging device for producing multicolor images from image data containing data representing an image of a first color and an image of a second color to be registered relative to the image of the first color onto a substrate by transferring toner of the first and second colors to the substrate, the imaging device comprising:

a first imager configured to generate an optical output corresponding to the image of the first color at a first exposure station, a second imager configured to generate an optical output corresponding to the image of the second color at a second exposure station;

a photoreceptor belt configured to have a charge placed thereon for modification by the optical output of the first imager to be receptive to a charged toner of the first color and for modification by the optical output of the second imager to be receptive to a charged toner of the second color, the photoreceptor belt being configured to include an index;

a plurality of rollers mounted to a frame of the imaging device for defining a process path along which the photoreceptor belt is driven in a process direction, the plurality of rollers comprising:

a drive roller having a longitudinal axis about which it is mounted to rotate and a drive surface formed generally concentrically about the longitudinal axis for which eccentricity versus phase angle from a reference point data is known, the drive surface having a nominal circumference and being configured to drive the photoreceptor belt; and a tensioning roller for providing tension to the photoreceptor belt as it is driven about the process path;

an angular position sensor for detecting the phase angle of the drive roller from the reference point;

a first index sensor mounted along the process path for sensing the passage of the index on the belt;

a second index sensor mounted along the process path for sensing the passage of the index on the belt;

an image data source for generating image data for generating an image including graphics of the first color and graphics of the second color, the image data including a line to be printed in the first color and in the second color;

a controller coupled to receive signals from the first index sensor, second index sensor, angular position sensor, first imager and image data source and configured to drive the second imager to generate an optical output, the controller including memory for storing the eccentricity versus phase angle from a reference point data, the time at which the first index sensor senses the passage of the index on the belt, and the time at which the second index sensor senses the passage of the index on the belt and a processor for calculating an appropriate time delay for starting the generation of the optical output of the second imager for printing the line to be printed in the first color and in the second color based on the time of the starting of the generation of the optical output by the first imager to print the line to be generated in the first color and in the second color, the signal received from the first index sensor, the signal received from the second index sensor, the signal received from the angular position sensor, and the eccentricity versus phase angle from a reference point data.

2. The device of claim 1 wherein the angular position sensor generates an integral number of pulses per revolution of the drive roller, the second exposure station is displaced along the process path from the first exposure station by a displacement that has a value substantially equal to an integer multiple of the nominal circumference of the drive surface of the drive roller and the appropriate time delay for starting the generation of the optical output of the second imager includes a component that comprises an integer number of pulses generated by the angular position sensor.

3. The device of claim 2 wherein the component that comprises an integer number of pulses generated by the angular position sensor has a value equal to the product of the integer by which the nominal circumference of the drive roller is multiplied to generate the value of the displacement between the first and second exposure stations times the integer number of pulses generated by the angular position sensor per revolution of the drive roller.

4. The device of claim 3 wherein the appropriate time delay includes a thermal growth factor component that calculated by the processor using the stored time at which the first index sensor sensed the passage of the index on the belt, and the stored time at which the second index sensor sensed the passage of the index on the belt.

5. The device of claim 4 wherein the processor utilizes an initial time for the belt to complete one rotation to calculate the thermal growth factor component.

6. The device of claim 5 wherein the processor utilizes a nominal time for a selected position on the belt to travel from the first exposure station to the second exposure station to calculate the thermal growth factor component.

7. The device of claim 5 wherein the processor utilizes a nominal time for the index in the belt to travel between the first and second index sensors to calculate the thermal growth compensation factor.

8. The device of claim 1 wherein the first index sensor is disposed along the process path between the drive roller and the first exposure station in the process direction.

9. The device of claim 8 wherein the second index sensor is disposed along the process path between the first index sensor and the first exposure station in the process direction.

10. The device of claim 1 wherein the second imager is a light emitting diode imager.

11. The device of claim 10 wherein the first imager is a rastor output scanner imager.

12. An imaging device for producing multicolor images from image data containing data representing an image of a first color and an image of a second color to be registered relative to the image of the first color onto a substrate by transferring toner of the first and second colors to the substrate, the imaging device comprising:

a raster output scanner ("ROS") imager configured to generate an optical output corresponding to the image of the first color at a first exposure station, a light emitting diode ("LED") imager configured to generate an optical output corresponding to the image of the second color at a second exposure station;

a photoreceptor belt configured to have a charge placed thereon for modification by the optical output of the ROS imager to be receptive to a charged toner of the first color and for modification by the optical output of the LED imager to be receptive to a charged toner of the second color;

a plurality of rollers mounted to a frame of the imaging device for defining a process path along which the photoreceptor belt is driven past the ROS and LED imagers in a process direction, the plurality of rollers comprising a drive roller having a longitudinal axis about which it is mounted to rotate and a drive surface formed generally concentrically about the longitudinal axis, the drive roller exhibiting an eccentricity for which a formula relating angular position as a function of the phase angle of the drive roller to eccentricity is known, the drive surface having a nominal circumference and being configured to drive the photoreceptor belt;

an angular position sensor for detecting the phase angle of the drive roller;

an image data source generating image data for generating an image including graphics of the first color and graphics of the second color, the image data including a line to be printed in the first color and in the second color; and a controller coupled to receive signals from the angular position sensor, ROS imager and image data source and configured to drive the LED imager to generate an optical output, the controller including memory for storing the formula relating angular position as a function of the phase angle of the drive roller to eccentricity and a processor for calculating an appropriate time delay for starting the generation of the optical output of the LED imager for printing the line to be printed in the first color and in the second color based on the time of the starting of the generation of the optical output by the ROS imager to print the line to be generated in the first color and in the second color, the signal received from the angular position sensor, and the formula relating angular position as a function of the phase angle of the drive roller to eccentricity.

13. The device of claim 12 and wherein the photoreceptor belt is configured to include an index and further comprising:

a first index sensor mounted along the process path for sensing the passage of the index on the belt;

a second index sensor mounted along the process path for sensing the passage of the index on the belt; and wherein the controller is coupled to receive signals from the first index sensor and second index sensor, and to store in memory the time at which the first index sensor senses the passage of the index on the belt, and the time at which the second index sensor senses the passage of the index on the belt and the calculation of the appropriate time delay utilizes the signal received from the first index sensor and the signal received from the second index sensor.

14. The device of claim 12 wherein the plurality of rollers further comprises a tensioning roller for providing tension to the photoreceptor belt as it is driven about the process path, the tensioning roller being mounted along the process path between the first exposure station and the second exposure station in the process direction.

15. The device of claim 14 and further comprising a stripper roller for guiding the photoreceptor belt when driven along the process path the stripper roller exhibiting an eccentricity for which a formula relating angular position as a function of the phase angle of the stripper roller to eccentricity is known, the stripper roller being mounted between the drive roller and the tensioning roller along the process path in the process direction and wherein the formula relating angular position as a function of the phase angle of the stripper roller to eccentricity is stored in memory and is utilized by the processor to calculate the appropriate delay.

16. The device of claim 15 wherein the photoreceptor belt is configured to include an index and further comprising:

a first index sensor mounted along the process path for sensing the passage of the index on the belt;

a second index sensor mounted along the process path for sensing the passage of the index on the belt; and wherein the controller is coupled to receive signals from the first index sensor and second index sensor and to store in memory the time at which the first index sensor senses the passage of the index on the belt, and the time at which the second index sensor senses the passage of the index on the belt and the calculation of the appropriate time delay utilizes the signal received from the first index sensor and the signal received from the second index sensor.

17. The device of claim 16 wherein the first index sensor is mounted along the process path between the stripper roller and the first exposure station in the process direction.

18. The device of claim 16 wherein the wherein the angular position sensor generates an integral number of pulses per revolution of the drive roller, the second exposure station is displaced along the process path from the first exposure station by a displacement that has a value substantially equal to an integer multiple of the nominal circumference of the drive surface of the drive roller and the appropriate time delay for starting the generation of the optical output of the LED imager includes a component that comprises an integer number of pulses generated by the angular position sensor.

19. The device of claim 18 wherein the component that comprises an integer number of pulses generated by the angular position sensor has a value equal to the product of the integer by which the nominal circumference of the drive roller is multiplied to generate the value of the displacement between the first and second exposure stations times the integer number of pulses generated by the angular position sensor per revolution of the drive roller.

20. The device of claim 19 wherein the appropriate time delay includes a thermal growth factor component that calculated by the processor using the stored time at which the first index sensor sensed the passage of the index on the belt, and the stored time at which the second index sensor sensed the passage of the index on the belt.

* * * * *